US006135290A

United States Patent [19]

Heiple

[11] Patent Number: 6,135,290

[45] Date of Patent: Oct. 24, 2000

[54] SIFTER ATTACHMENT FOR EXCAVATING MACHINES AND THE LIKE

[75] Inventor: Ashley E. Heiple, Alum Bank, Pa.

[73] Assignee: Rockland Manufacturing Company, Bedford, Pa.

[21] Appl. No.: 09/092,459

[22] Filed: Jun. 5, 1998

[51] Int. Cl.[7] ..... B07B 1/49; B07B 1/00

[52] U.S. Cl. ..... 209/421; 209/235; 209/418; 37/903

[58] Field of Search ..... 37/901, 903, 904, 37/403, 188; 172/32; 171/132; 209/421, 235, 418, 419; 414/725, 912

[56] References Cited

U.S. PATENT DOCUMENTS

| | | | |
|---|---|---|---|
| 3,003,265 | 10/1961 | Lutjens | 37/118 |
| 3,765,490 | 10/1973 | Logue | 171/132 |
| 4,805,703 | 2/1989 | Carlsson | 171/132 |
| 4,858,346 | 8/1989 | Schulte | 37/184 |
| 5,160,034 | 11/1992 | Potter | 209/38 |
| 5,172,498 | 12/1992 | Wack | 37/103 |
| 5,178,484 | 1/1993 | Strunk | 404/75 |
| 5,241,764 | 9/1993 | Modig | 37/405 |
| 5,493,796 | 2/1996 | Ballew et al. | 37/142.5 |
| 5,528,844 | 6/1996 | Ellis | 37/403 |
| 5,553,408 | 9/1996 | Townsend | 37/406 |
| 5,596,824 | 1/1997 | Scott et al. | 37/403 |
| 5,692,875 | 12/1997 | Boman | 414/725 |
| 5,743,030 | 4/1998 | Sirr | 37/406 |
| 5,771,612 | 6/1998 | Lynch | 37/142.5 |
| 5,927,933 | 7/1999 | Tucker | 414/729 |
| 5,964,050 | 10/1999 | Svahn | 37/409 |

*Primary Examiner*—Donald P. Walsh
*Assistant Examiner*—Daniel K Schlak
*Attorney, Agent, or Firm*—Lalos & Keegan

[57] ABSTRACT

An assembly connectable to a boom of a machine operable to perform material working functions generally consisting of a handle connectable to the boom; a fluid actuated cylinder assembly operatively interconnecting the boom and handle for pivotally displacing the handle relative to the boom; a bucket member connected to the handle for pivotal movement along an arcuate line of travel between uncurled and curled positions; a fluid actuated cylinder assembly operatively interconnecting the handle and the implement for displacing the implement between uncurled and curled positions; a sifting member connected to the handle for pivotal movement along an arcuate path between retracted and extended positions, at least partially overlapping the arcuate path of the implement whereby when the sifting member is in the retracted position, the implement is in the curled position and the sifting member is displaced from the retracted position to the extended position, the sifting member will be caused to engage and displace the implement from the curled to the uncurled position, and a fluid actuated cylinder assembly for pivotally displacing the sifting member between the retracted and extended positions. Control means further is provided to operate the displacing means in causing the sifting member to be disposed in its retracted position, the implement to be displaced to its uncurled position, the implement to be displaced from its uncurled position to its curled position into engagement with the sifting member, the sifting member to be displaced from its retracted position to its extended position thereby displacing the implement to its uncurled position and the sifter to be displaced to its retracted position.

30 Claims, 4 Drawing Sheets

SIFTER ATTACHMENT FOR EXCAVATING MACHINES AND THE LIKE

This invention relates to a sifter assembly and more particularly to a sifter assembly which may be attached to a ground working or material handling machine such as an excavator for sifting material being excavated of otherwise processed.

BACKGROUND OF THE INVENTION

In certain excavating operations where the material being excavated consists of coarse and fine aggregates such as rocks and soil, it often is desired to extract only the coarser aggregate which requires sifting the coarse aggregate from the fine aggregate. Such sifting may be accomplished by excavating both the coarse and the fine aggregate at an excavating site, transporting such excavated aggregate to another work site equipped with a sifting apparatus and then processing such material in such apparatus to accomplish the desired sifting. A more efficient manner of accomplishing such a sifting is to provide for means on the excavating equipment to perform the sifting during the excavating operation. Examples of such means are illustrated and described in U.S. Pat. Nos. 3,003,265 to Lutzens, 3,765,490 to Logue, 4,805,703 to Carlson, 4,858,346 to Shule, 5,160,034 to Potter, 5,172,498 to Wack and 5,528,844 to Ellis.

Prior part devices mountable on excavating machines for sifting aggregate at excavating sites have been found not to be entirely satisfactory in terms of simplicity of design, ease of manufacture and/or performance in service. Accordingly, it is the principal object of the present invention to provide an improved assembly mountable on a ground working or material handling machine for sifting material at work sites which is simple in design, easy to manufacture and maintain, simple to operate and effective in performance.

SUMMARY OF THE INVENTION

An embodiment of the present invention consists of an assembly connectable to the boom of a machine operable to perform ground working or material handling functions, such as an excavator, generally comprising a handle connectable to the boom of the machine, a fluid actuated cylinder assembly operatively interconnectable to the boom and handle for pivotally displacing the handle relative to the boom, an implement connected to the handle for pivotal movement along an arcuate path between curled and uncurled positions, a fluid actuated cylinder assembly interconnecting the handle and the implement for displacing the implement between the curled and the uncurled positions, a sifter connected to the handle for pivotal movement along an arcuate path between retracted and extended positions, at least partially overlapping the arcuate path of the implement whereby when the sifter is in the retracted position, the implement is in the curled position and the sifter is displaced from the retracted position to the extended position, the sifter will be caused to engage and displace the implement from the curled position to the uncurled position, and a fluid actuated cylinder assembly interconnecting the handle and the sifter for angularly displacing the sifter between the retracted and extended positions. The embodiment further includes control means disposed on the machine and operatively connected to the various cylinder assemblies to selectively position the sifter in its retracted position and curl and uncurl the implement to operate the implement independently of the sifter, and sequentially retract the sifter to its retracted position, displace the implement from the uncurled to the curled position into engagement with the sifter in the retracted position, scooping material of different particle sizes between the implement and the sifter as in an excavating operation, displace the sifter from its retracted position to its extended position correspondingly causing the implement to displace from its curled to its uncurled position and the finer particles of the material confined between the sifter and the implement to fall through the perforations in the sifter, and then displace the sifter from its extended position to its retracted position, allowing the residual material previously confined between the sifter and the implement to be dumped.

DESCRIPTION OF THE PREFERRED EMBODIMENT OF THE INVENTION

Figure 5:
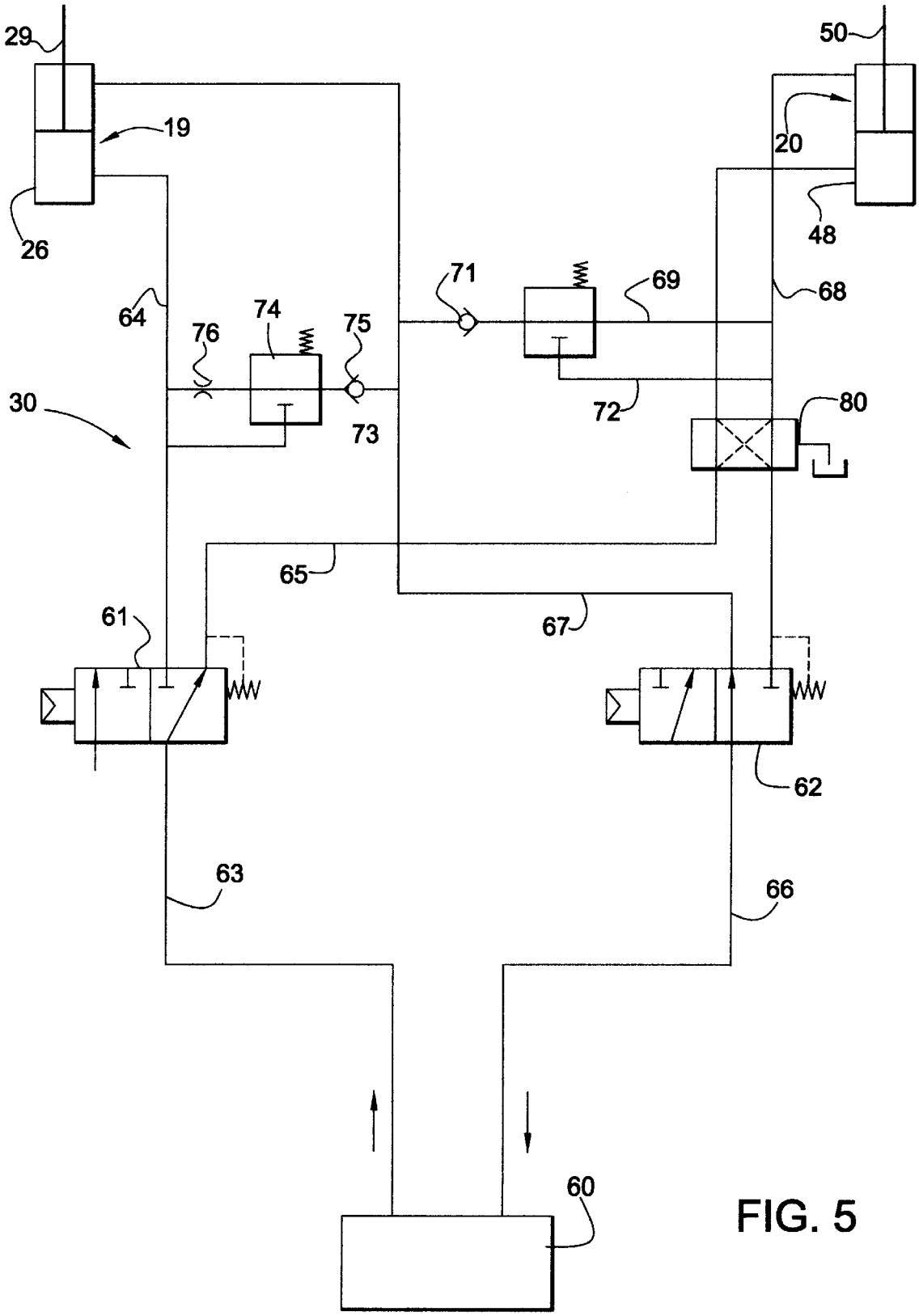
FIG. 5 is a schematic-diagrammatic view of the control system of the embodiment shown in FIGS. 1 through 4.

Referring to the drawings, there is illustrated a front end assembly 10 of an excavating machine, embodying the present invention. The assembly includes a boom 11 pivotally connected to the platform of the machine for angular displacement about a horizontal axis, a handle or dipper stick 12 pivotally connected to the free end of the boom by means of a pin 13 for angular displacement relative to the boom about a horizontal axis, a bucket 14 pivotally connected to the free end of handle 12 by means of a pin 15 for angular displacement relative to the handle about a horizontal axis and a sifter 16 pivotally connected to a bracket 17 depending from the underside of handle 12 by means of a pin 18 for angular displacement of the sifter relative to the handle about an axis spaced from and adjacent and disposed parallel to the axis of pin 15. In the conventional manner, boom 11 is angularly displaced relative to the platform of the machine by means of a hydraulic cylinder assembly operatively interconnecting the platform and the boom, the handle is angularly displaced relative to the boom by means of a hydraulic cylinder assembly operatively interconnecting the boom and the handle, the bucket is angularly displaced relative to the handle by means of a hydraulic cylinder assembly 19 and the sifter is angularly displaced relative to the handle by means of a hydraulic cylinder assembly 20. Also in the conventional manner, the handle is provided with a support link 21 pivotally connected at an inner end thereof to the handle by means of a pin 22, and a connecting link 23 operatively interconnecting the outer end of support link 21 and bucket 14 by means of a pair of connecting pins 24 and 25. Cylinder assembly 19 includes a cylinder member 26 connected to a bracket 27 formed on an upper side of the handle by means of a connecting pin 28, and a rod member 29 connected to pin 24. Cylinder assemblies 19 and 20 are operated by a control system 30 as shown in FIG. 5.

Bucket 14 is of a conventional construction including a pair of spaced side walls 31,31 providing a pair of spaced side cutting edges 32,32, a top wall 33 provided with a pair of spaced brackets 34,34 connecting the bucket to the handle and connecting link 23 by means connecting pins 15 and 25, and a curved rear wall 35 merging gradually into a bottom wall 36 provided with a set of transversely disposed, protruding teeth 37. Side walls 31,31 and top and bottom walls 33 and 36 cooperate to provide an opening 38 through which material may be scooped during a normal excavating operation. In the conventional manner, the cylinder assemblies for the boom, handle and bucket may be operated to maneuver the bucket to scoop up material. The operation of cylinder assembly 19 will cause the bucket to swing through an arcuate line of travel between an uncurled position when rod member 29 is fully retracted to a curled position when rod 29 is fully extended.

Figures 1, 4:
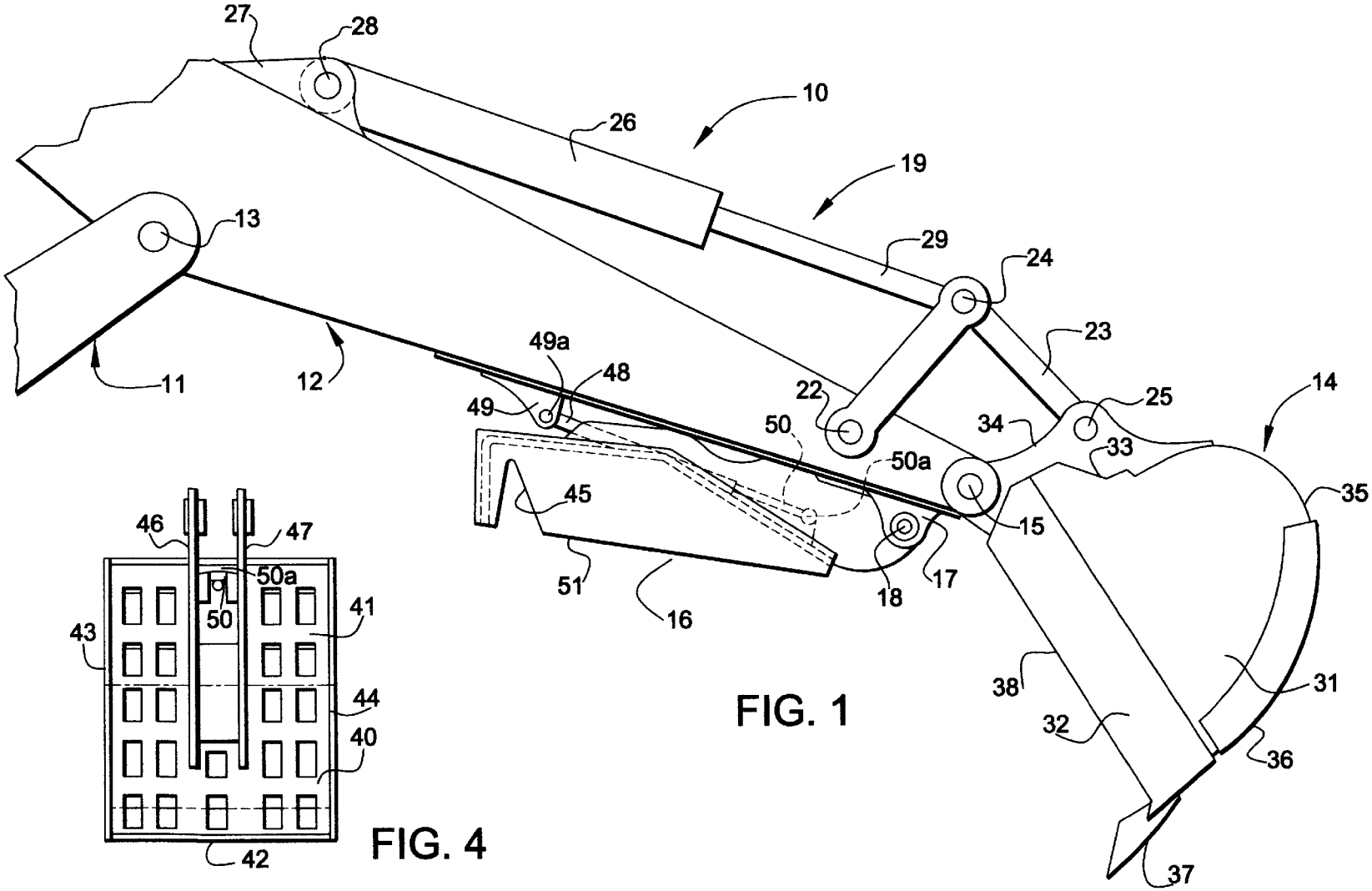
FIG. 1 is a side elevational view of the front end assembly of an excavating machine embodying the present invention, illustrating the components thereof in a first of a sequential set of positions.
FIG. 4 is a cross-sectional view along line 4—4 in FIG. 2.
Figure 2:
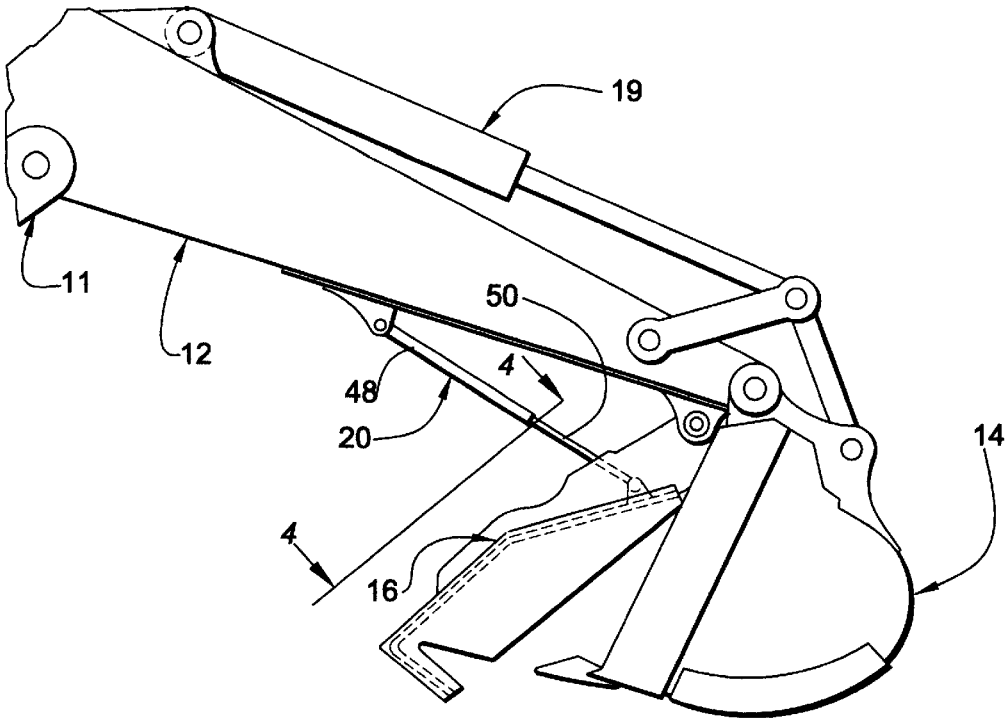
FIG. 2 is a view similar to the view shown in FIG. 1, illustrating the components in subsequent positions of the set of positions of the components.
Figure 3:
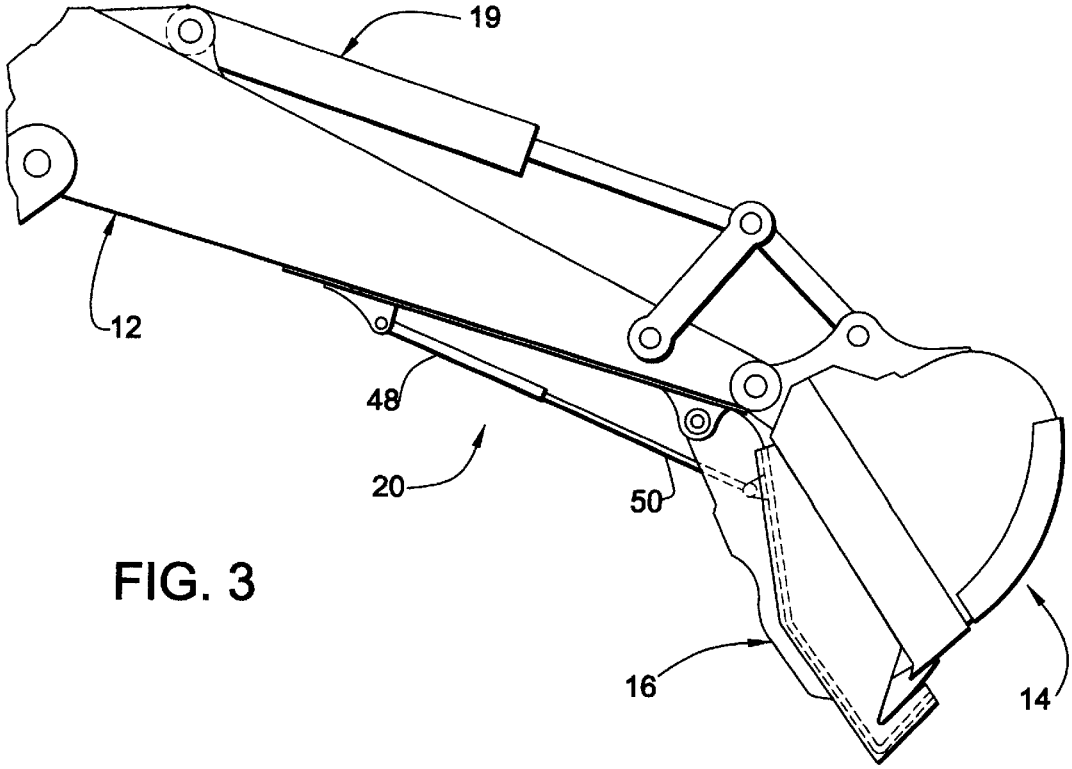
FIG. 3 is a view also similar of the view shown in FIG. 1, illustrating the components in more subsequent positions the set of positions thereof.

As best seen in FIGS. 1 and 4, sifter 16 includes a bottom perforated wall 40, a rear perforated wall 41 disposed at a small angle relative to the plane of the bottom wall, a front wall 42 and a pair of spaced side walls 43 and 44 provided with transversely aligned, V-shaped recesses 45,45 which are adapted to receive the outer ends of teeth set 37 of the bucket in a manner as later described. The bottom and rear walls of the member are provided with a pair of transversely spaced mounting brackets 46 and 47 which are pivotally connected to the underside of the handle by means of connecting pin 18. The sifter is pivoted relative to the handle by means of cylinder assembly 20 which includes a cylinder member 48 pivotally connected to a depending bracket 49 mounted on the underside of the handle by means of a connecting pin 49*a*, and a rod member 50 pivotally connected to a pin 50*a* rigidly secured to brackets 46 and 47. Side walls 43 and 44 and front and rear end walls 41 and 42 of the sifter cooperate to provide a material receiving opening 51. Cylinder assembly 20 is operable to angularly displace the sifter along an arcuate path of travel between a fully retracted position as shown in FIG. 1 to a fully extended position, partially overlying the arcuate path of travel of bucket 14. The lengths and spacing of side walls 43 and 44 of the sifter are designed so that the configuration and cross-sectional area of opening 51 of the sifter will approximate the configuration and cross-sectional area of inlet opening 38 of the bucket. The geometry of the bucket and sifter and their pivotal connections with the handle, including the spacing of the axes of connecting pins 15 and 18, the angular displacement of a plane passing through the axes of connecting pins 15 and 18 from a plane passing through the axis of connecting pin 15 and disposed normal to the longitudinal centerline of handle 12, the radial dimension between the axis of connecting pin 15 and the tips of teeth 37, the radial dimension between the axis of connecting pin 18 and a line aligned with the troughs of recesses 45 of the sifter and the configurations of recesses 45 in the side walls of the sifting member, further is designed in a manner whereby when the sifter is in the retracted position as shown in FIG. 1 and the bucket is in its fully curled position, engaging the sifter, the outer teeth of teeth set 37 of the bucket will be received within recesses 45,45 in the side walls of the sifter, side walls 31,31 of the bucket will be aligned or closely within or without side walls 43 or 44 of the sifter and openings 51 of the sifter and 38 of the bucket will intercommunicate within an enclosure comprising the bucket and sifter disposed in a closed relation, and when rod member 50 of cylinder assembly 20 is extended with the bucket and sifter in such closed relationship, such members will remain in such closed relationship as the sifter causes the bucket to angularly displace between its fully curled and fully uncurled positions.

Control system 30 is operable to maneuver the bucket independently of the sifter in a conventional excavating manner by curling and uncurling the bucket, and to maneuver the bucket and sifter together to provide an excavating and sifting operation. Such latter operation is effected by initially positioning the sifter in the retracted position as shown in FIG. 1, positioning the bucket member in the fully uncurled position, maneuvering the front end assembly of the machine and curling the bucket from its fully uncurled to its fully curled position engaging the sifter, to scoop a load of aggregate of large and small particles such as rocks and soil, allowing rod member 29 of cylinder assembly 19 to float freely, and extending the rod member of cylinder assembly 20 to cause the sifter to pivot from its fully retracted position to its fully extended position correspondingly moving the bucket and the load of aggregate contained within the bucket and sifter, as a unit, to the fully uncurled position of the bucket whereby the smaller particles of the load carried in the body of the closed sifter and bucket will be caused to fall through the perforations in the sifter, and retracting rod member 50 of cylinder assembly 20 to cause the sifter to move from its fully extended to its fully retracted position after the front end assembly has been swung to move the bucket to a dump position, permitting the larger particles of the load to fall, repositioning the bucket and sifter in their initial positions to perform a next digging, sifting and dumping cycle.

The system includes a master control valve 60 and pair of selector valves 61 and 62. A fluid line 63 connects control valve 60 and selector valve 61. A fluid line 64 inter-connects selector valve 61 and the base end of cylinder member 26 of cylinder assembly 19, and a fluid line 65 interconnects selector valve 61 and the base end of the cylinder member 48 of cylinder assembly 20 so that the selector valve may be operated to selectively communicate fluid line 63 with the base ends of cylinder members 26 and 48. A fluid line 66 intercommunicates control valve 60 and selector valve 62. A fluid line 67 intercommunicates selector valve 62 and the rod end of cylinder member 26, and a fluid line 68 intercommunicates selector valve 62 and the rod end of cylinder member 48 so that selector valve 62 may be operated to communicate fluid line 66 selectively with the rod ends of cylinder members 26 and 48. In the conventional manner, control valve 60 is operatively connected to a source of fluid under pressure and a fluid reservoir, and may be operated to selectively supply fluid under pressure to one of lines 63 and 66 while connecting the other to tank.

Intercommunicating fluid lines 67 and 68 is a fluid line 69 provided with a pressure responsive valve 70 and a check valve 71. Pressure responsive valve 70 normally is disposed in the open position to allow the flow of fluid from the rod end of cylinder member 48 to fluid line 67 intercommunicating selector valve 62 and the rod end of cylinder member 26. Valve 70 is responsive to a predetermined pressure in the rod end of cylinder member 48 by means of fluid line 72 to close upon attainment of such predetermined pressure. A fluid line 73 including a pressure responsive valve 74, a check valve 75 and a restriction 76 intercommunicates fluid lines 64 and 67. Valve 74 is normally in the open position allowing restricted flow from fluid line 64 to fluid line 67. Valve 74 further is responsive to a predetermined pressure in the base end of cylinder member 26 to close and thus preclude the flow of fluid from fluid line 64 to fluid line 67. Operatively connected to fluid lines 65 and 68 is a conventional set of balancing valves with makeup checks, designated generally as 80.

To operate the assembly in the exclusively excavating mode, with the sifter in the retracted position as shown in FIG. 1, selector valve 61 is operated to communicate fluid line 63 with fluid line 64, intercommunicating control valve 60 with the base end of cylinder member 26, and selector valve 62 is operated to communicate fluid line 66 with fluid line 67 and thus intercommunicate control valve 60 with the rod end of cylinder member 26. The main control valve then may be operated to supply fluid under pressure to opposite ends of cylinder member 26 to curl and uncurl the bucket member to perform various digging functions.

To operate the assembly in the excavating and sifting mode, with the sifting member in the fully retracted position and the bucket member in the fully uncurled position, as shown in FIG. 1, the selector valves are operated in the manner previously described and the main control valve is operated to provide fluid under pressure through fluid lines 63 and 64 to the base end of cylinder member 26 to extend rod member 29 thus causing the bucket member to pivot from its fully uncurled position to its fully curled position, into engagement with the sifting member disposed in its fully retracted position, thereby scooping up a load of aggregate including large and small particles. With the sifter in its fully retracted position and the bucket in its fully curled position holding a load of excavated material, selector values 61 and 62 are shifted to the positions as shown in FIG. 5 and control valve 60 further is operated to provide fluid under pressure through fluid lines 63 and 65 to the base end of cylinder member 48 to extend rod member 50 and thus cause the sifter to pivot from its fully retracted to its fully extended position. As the sifter thus displaces, it correspondingly will cause the bucket to pivot from its fully curled to its fully uncurled position. As the bucket uncurls with the sifter following, the finer particles of the load carried by the engaging sifter and bucket will be caused to fall through the perforations in the sifter. As rod member 50 extends, fluid from the rod end of cylinder member 48 will flow through fluid lines 68, 69, 67 and 66 to return to tank. Concurrently, rod member 29 of cylinder assembly 19 will be caused to retract thereby causing fluid to flow through fluid lines 64, 73, 67 and 66 to tank. Fluid discharged from either the base end of cylinder member 26 or the rod end of cylinder member 48 will be caused to flow to the rod end of cylinder member 26 to allow rod member 29 to freely retract. When the smaller particles are sifted from the elevated assembly, suitable controls on the machine may be operated to swing the front end assembly and thereby position the sifter and bucket assembly containing the larger particles at a selected dump position.

To retract the sifter, allow the larger particles to be dumped and position the bucket and sifter to positions to begin another excavating or excavating and sifting cycle, selector valve 61 is operated to communicate fluid line 63 with fluid line 65, selector valve 62 is operated to communicate fluid line 66 with fluid line 68 and control valve 60 is operated to supply fluid under pressure through fluid line 66 and 68 to the rod side of cylinder member 48. Such operation will cause rod member 50 to retract and correspondingly cause the sifter to pivot from its fully extended to its fully retracted position as shown in FIG. 1. Fluid discharged from the base end of cylinder member 48 would be caused to flow through fluid lines 65 and 63 to tank. Under such conditions, rod member 29 would remain fully retracted to maintain the bucket in its fully uncurled position.

It will be appreciated that the assembly as described may be used selectively either in the exclusively excavating mode or the excavating and sifting mode to provide a greater versatility of operation. While it is contemplated that the assembly as described may be utilized for normal earth excavating operations and such excavating and the sifting of rocks from soil, it further is contemplated that the assembly may be used to handle other types of materials. In particular, the assembly may be used for dredging operations in which it is desired to remove water from a load scooped from the bed of a body of water. In such an operation, the assembly may be utilized to drain the water from the assembly prior to dumping the solid particles on a barge or an adjoining land site. In addition, the assembly may be utilized in any application where materials of different particle sizes are being scooped and it is desired to sift the larger sized particles from the smaller particles. The classification of the particles being sifted in any application may be provided by the selection of the size of the perforations in the sifter. In this regard, it further is contemplated that plates containing openings of different sizes may be mounted in an interchangeable manner in the sifter.

In another embodiment of the invention, the bucket and the sifter may be connected to the handle so that they pivot about the same axis. The geometries of such members are modified so that when the sifter is in its fully retracted position and the bucket is curled, the bucket will engage the sifter to cause the sifter to close the bucket opening. When the sifter and bucket are in such positions and the sifter is displaced from its fully retracted to its fully extended position, to uncurl the bucket, the sifter will maintain engagement with the bucket to continue to maintain the opening in the bucket closed, allowing the smaller aggregate to fall through the sifter. A system as shown in FIG. 5 also may be used in such embodiment to operate the bucket and sifter selectively in the scooping and dumping and the scooping, sifting and dumping modes.

In a still further embodiment of the invention, the bucket and sifter may be mounted on the handle as shown in FIGS. 1 through 4 and the control system shown in FIG. 5 may be modified to cause the sifter to follow the bucket when the assembly is operating in the scooping, sifting and dumping mode, the sifter is positioned in its fully retracted position, the bucket is in its fully curled position in engagement with the sifter and the bucket is uncurled, in lieu of the sifter displacing the bucket. Such system would include circuitry for operating cylinder assembly 19 independently of cylinder assembly 20 to curl and uncurl the bucket, in the scooping and dumping mode, and operating cylinder assembly 20 independently of cylinder assembly 19 to retract the sifter and operating both cylinder assemblies synchronously to cause the sifter to follow the buckelt as it uncurls, maintaining the bucket closed to sift the larger aggregates. Synchronization of the pivotal movements of the sifter and bucket may be achieved by selectively intercommunicating the base ends of cylinder members 26 and 48 while supplying fluid under pressure to the rod end of cylinder member 26, with compensating means being provided to provide for differential chamber volumes.

Figure 6:
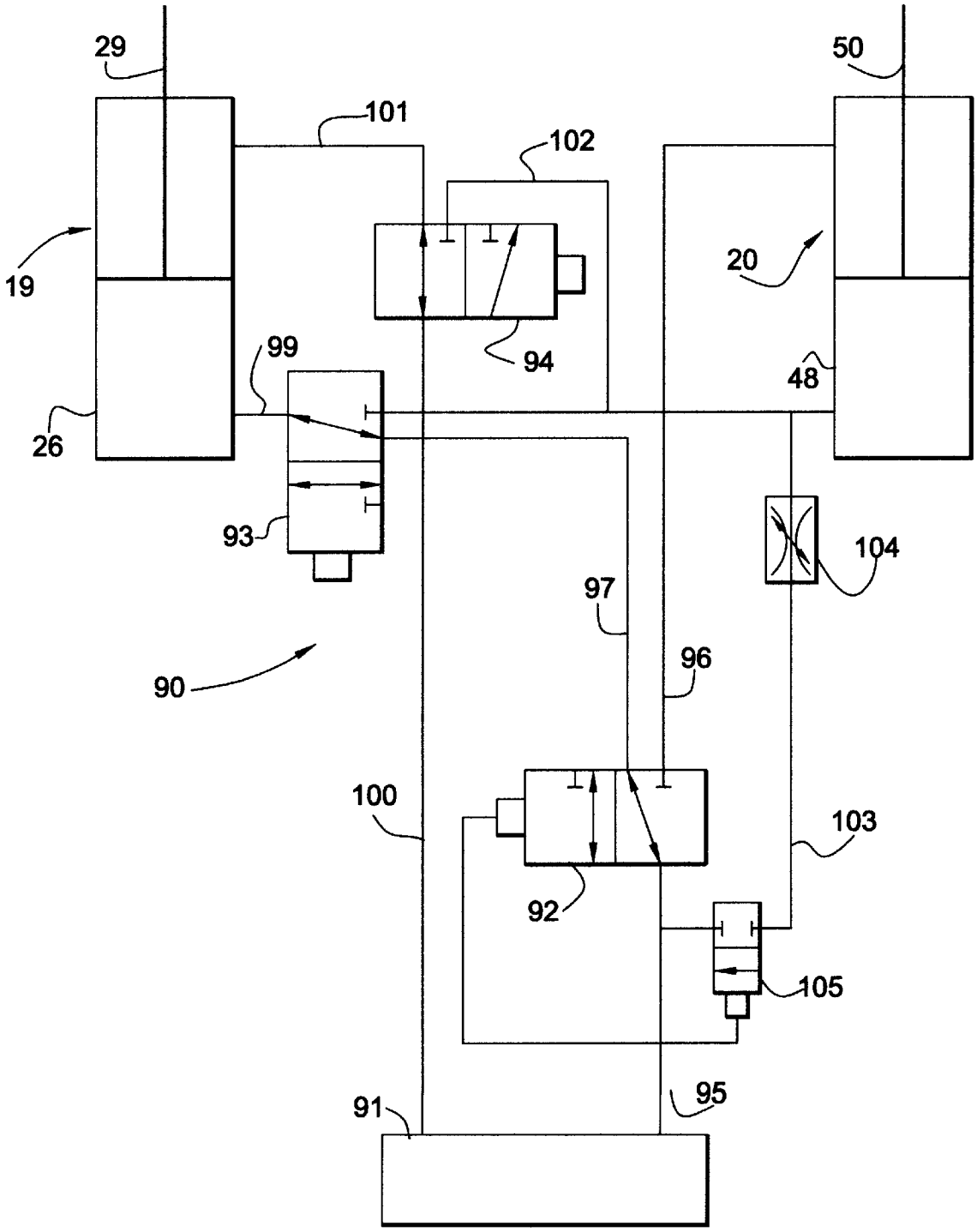
FIG. 6 is a schematic-diagrammatic view of an alternative control system which may be used with the embodiment shown in FIGS. 1 through 4.

FIG. 6 illustrates a control system 90 selectively operable to curl and uncurl bucket 14 independently of sifter 16, as in the exclusively digging and dumping mode of the machine, extending and retracting the sifter independent of the bucket and sequentially curling the bucket to scoop a load of material being excavated, simultaneously uncurling the bucket and extending the sifter to an elevated position to cause the sifter to closely follow the bucket, closing the opening therein and allowing the finer material disposed within the bucket to be sifted out of the load carried by the bucket and sifter, fully uncurling the bucket, dumping the oversized material in the sifter and retracting the sifter, as in the digging, sifting and dumping mode of the machine. The system includes a master control valve 91 connected to a source of fluid under pressure and a set of solenoid selector valves 92, 93 and 94. A fluid line 95 interconnects ports of master control valve 91 and selector valve 92, a fluid line 96 interconnects a port of selector valve 92 and the rod end of cylinder member 20, and a fluid line 97 interconnects ports of selector valves 92 and 93 so that valve 92 may be operated to selectively intercommunicate fluid line 95 with either fluid lines 96 and 97. A fluid line 98 connects the base end of cylinder member 48 with a port of selector valve 93 and a fluid line 99 interconnects a port of valve 93 and the base end of cylinder member 26 so that selector valve 93 may be operated to selectively intercommunicate fluid line 99 with fluid line 97 or 98. A fluid line 100 interconnects master control valve 91 and a port of selector valve 94, a fluid line 101 interconnects a port of selector valve 94 and the rod end of cylinder member 26 and a fluid line 102 interconnects a port of selector valve 94 and fluid line 98 so that selector valve 94 may be operated to selectively communicate fluid line 100 with fluid line 101 or 102. Interconnecting fluid lines 98 and 95 is a fluid line 103 which includes an adjustable bleed-off flow control valve 104 and a solenoid operated valve 105 wired in a manner to be energized when valve 93 is energized.

In their normal, deenergized conditions as shown in FIG. 6, selector valve 92 will intercommunicate fluid lines 95 and 97, selector valve 93 will intercommunicate fluid lines 97 and 99 and selector valve 94 will intercommunicate fluid lines 100 and 101. Under such conditions, master control valve 91 may be operated to extend and retract rod member 29 to uncurl and curl the bucket independent of the sifter. To uncurl the bucket, fluid under pressure is applied to fluid line 100 and flows through selector valve 94 and fluid line 101 to the rod end of cylinder member 26 to retract rod member 29. Fluid expelled from the base end of cylinder member 26 is caused to flow through fluid line 99, selector valve 93, fluid line 97, selector valve 92, fluid line 95 and through control valve 91 and tank. To curl the bucket, fluid under pressure is applied to fluid line 95 and through selector valve 92, fluid line 97, selector valve 93 and fluid line 99 to the base end of cylinder member 26 to extend rod member 29. As the rod member extends, fluid in the rod end of cylinder member 26 is expelled through fluid line 101, selector valve 94 and fluid line 100 to control valve 91 and tank. Under such conditions, the sifter normally would be maintained in the fully retracted position so that the bucket may be curled and uncurled as in the exclusively digging and dumping mode.

In the digging, sifting and dumping mode, when the sifter is in the retracted position against the underside of the handle and the bucket has curled to scoop a load of material and engage the retracted sifter, the bucket may be uncurled to an elevated intermediate position with the sifter following and closing the opening in the bucket by energizing selector valves 92 and 93 and operating control valve 91 to apply fluid under pressure to fluid line 100 to cause rod member 29 to retract and the bucket correspondingly to uncurl. Fluid expelled from the base end of cylinder member 26 will flow through fluid line 99, selector valve 93 and fluid line 98 to the base end of cylinder member 48, causing rod member 50 to extend and the sifter correspondingly to pivot, following the bucket as it uncurls. Fluid from the rod end of cylinder member 48 is expelled through fluid line 96, selector valve 92 and fluid line 95 and through the control valve to tank. With valve 105 being energized along with selector valve 93, excess pressure in the base end of cylinder member 48 causing rod member 50 to extend and possibly overrun the uncurling bucket, will be relieved by the flow of fluid through flow control valve 104, fluid line 103 and valve 105 to return line 95. Flow control valve 104 may be adjusted to provide the amount of relief desired in the base end of cylinder member 48. As the bucket and sifter, holding a load of material, is thus elevated, the energization of selector valves 92 and 93 may be interrupted intermittently to cause the finer material in the load to be sifted.

Once the bucket and sifter are positioned in the intermediate elevated position and the finer material of the load has been sifted, the boom of the machine may be swung to position the elevated load above the dumping site and the bucket may be uncurled to its fully uncurled position by deenergizing the selector valves 92 and 93 and operating control valve 91 to apply fluid under pressure to fluid line 100 and through selector valve 94 and fluid line 101 to the rod end of cylinder member 26. Fluid expelled from the base end of cylinder member 26 will flow through fluid line 99, valve 93, fluid line 97, valve 92 and fluid line 95 to the control valve and tank.

With the sifter in the elevated position and the bucket in the fully uncurled position, the residual material held by the sifter may be dumped by energizing selector valves 92 and 93 and operating control valve 91 to apply fluid under pressure to fluid line 95 and through selector valve 92 and fluid line 96 to the rod end of cylinder member 48, causing rod member 50 to retract and correspondingly cause the sifter to swing downwardly to its rest position along the underside of the handle. As rod member 50 of cylinder assembly 20 retracts, fluid expelled from the base end of cylinder member 48 will be caused to flow through fluid line 98, selector valve 93 and fluid line 99 to the base end of cylinder member 26, causing rod member 29 to extend and the bucket correspondingly to curl. Fluid expelled from the rod end of cylinder member 26 will flow through fluid line 101, selector valve 94 and fluid line 100 and through the control valve to tank.

With the bucket in the fully uncurled position, selector valves 92 and 94 may be energized and the control valve may be operated to extend and retract the sifter. With valves 92 and 94 energized, by applying fluid under pressure to fluid line 100 and through selector valve 94 and fluid lines 102 and 98 to the base end of cylinder member 48, rod member 50 will be caused to extend and fluid expelled from the rod end of cylinder member 48 will be caused to flow through flow line 96, selector valve 92 and fluid line 95 to control valve 91 to tank. Fluid under pressure applied to fluid line 95 will flow through selector valve 92 and fluid line 96 to the rod end of cylinder member 48 to cause rod member 50 to retract. Fluid expelled from the base end of cylinder member 48 will flow through fluid lines 98 and 102, selector valve 94 and fluid line 100 through control valve 91 to tank.

From the foregoing detailed description it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly connectable to a boom of a machine operable in performing a material working function comprising:

a handle connectable to said boom;

first means connectable to said boom and connected to said handle for angularly displacing said handle relative to said boom;

an implement connected to said handle for angular displacement along an arcuate line of travel between uncurled and curled positions;

second means operatively interconnecting said handle and said implement for angularly displacing said implement between said uncurled and curled positions;

a sifting member connected to said handle for angular displacement along an arcuate line of travel between retracted and extended positions, at least partially overlapping the arcuate line of travel of said implement whereby when said sifting member is in said retracted position, said implement is in said curled position and when said sifting member is angularly displaced from said retracted position to said extended position, said sifting member will be caused to engage and angularly displace said implement from said curled position to said uncurled position;

third means operatively interconnecting said handle and said sifting member for pivotally displacing said sifting member between said retracted and extended positions; and control means operatively connected to said second and third displacing means operable to displace said sifting member to said retracted position, displace said implement to said uncurled position, displace said implement from said uncurled position to said curled position into engagement with said sifting member, displacing said sifting member from said retracted position to said extended position thereby displacing said implement from said curled to said uncurled position and displacing said sifting member to said retracted position.

2. An assembly according to claim 1 wherein the pivot axes of said implement and said sifting member are spaced.

3. An assembly according to claim 2 wherein said implement is pivotally connected to a free end of said handle and said sifting member is pivotally connected to an underside of said handle.

4. An assembly according to claim 1 wherein said second and third displacing means comprise fluid actuated cylinder assemblies.

5. An assembly according to claim 1 wherein said implement comprises a bucket member having an opening closable by said sifting member when said bucket member engages said sifting member.

6. An assembly according to claim 5 wherein said sifting member includes a bottom perforated panel, a front wall and a pair of side walls.

7. An assembly according to claim 6 wherein said bucket member is provided with a bottom wall having protruding cutting means, and the side walls of said sifting member are provided with transversely aligned recesses for receiving portions of said protruding cutting means when said bucket engages said sifting member.

8. An assembly according to claim 1 wherein said control system is selectively operable to displace said implement between curled and uncurled positions independent of the operation of the of said sifting member.

9. An assembly mountable on a machine having a boom, a handle pivotally connected to said boom, a first means operatively interconnecting said boom and said handle for angularly displacing said handle relative to said boom, operable in performing material working functions comprising:

an implement connectable to said handle for pivotal movement along an arcuate line of travel between uncurled and curled positions;

second means operatively interconnectable between said handle and said implement when said implement is mounted on said handle for displacing said implement between said uncurled and curled positions;

a sifting member connectable to said handle for pivotal movement along an arcuate line of travel between retracted and extended positions at least partially overlapping the arcuate line of travel of said implement when said implement and sifting member are connected to said handle whereby when said sifting member is in said retracted position, said implement is in said curled position and when said sifting member is displaced from said retracted position to said extended position, said sifting member will be caused to engage and displace said implement from said curled position to said uncurled position;

third means operatively connectable to said handle and connected to said sifting means for pivotally displacing said sifting member between said retracted and extended positions when said sifting member is connected to said handle; and control means operatively connectable to said second and third displacing means operable to displace said sifting member to said retracted position, displace said implement to said uncurled position, displace said implement from the uncurled position to the curled position into engagement with said sifting member, displacing said sifting member from said retracted position to said extended position thereby displacing said implement to said uncurled position and displacing said sifting member to said retracted position when said implement and sifting member are connected to said handle.

10. An assembly according to claim 9 wherein said pivot axes of said implement and sifting member are spaced when said implement and sifting member are connected to said handle.

11. An assembly according to claim 10 wherein said implement is pivotally connectable to a free end of said handle and said sifting member is pivotally connectable to an underside of said handle.

12. An assembly according to claim 9 wherein said second and third displacing means comprise fluid accuated cylinders assemblies.

13. An assembly according to claim 9 wherein said implement comprises a bucket member having an opening closed by said sifting member when said sifting member and bucket member are connected to said handle and said sifter member engages said bucket member.

14. An assembly according to claim 13 wherein said sifting member includes a perforated bottom panel, a front wall and pair of side walls.

15. An assembly according to claim 14 wherein said bucket member is provided with a bottom wall having protruding cutting means, and the side walls of said sifting member are provided with transversely aligned recesses for receiving portions of said cutting means when said bucket member and sifting member are connected to said handle and said sifting member engages said bucket member.

16. An assembly according to claim 9 wherein said control system is selectively operable to displace said implement between said curled and uncurled positions while said sifting member is maintained in said retracted position.

17. An assembly mountable on a machine having a boom, a handle pivotally connected to said boom, first means operatively interconnecting said boom and said handle for angularly displacing said handle relative to said boom, an implement connected to said handle for pivotal movement along an arcuate line of travel between uncurled and curled positions, and second means operatively interconnecting said handle and said implement for angularly displacing said implement relative to said handle, operable to perform material working functions comprising;

a sifter member connectable to said handle for pivotal movement along an arcuate line of travel between retracted and extended positions, at least partially overlapping the arcuate line of travel of said implement whereby when said sifting member is connected to said handle and in said retracted position, said implement is in said curled position and when said sifting member is displaced from said retracted position to said extended position, said sifting member will be caused to engage and displace said implement from said curled position to said uncurled position;

third means operatively connectable to said handle and connected to said sifting member for pivoting said sifting member between said retracted and extended positions when said sifting member is connected to said handle; and control means operatively connectable to said second and third displacing means when said sifting member is mounted on said handle, operable to displaced said sifting means to said retracted position, displace said implement to said uncurled position, displace said implement from said uncurled position to said curled position into engagement with said sifting member, displacing said sifting member from said retracted position to said extended position thereby displacing said implement to said uncurled position.

18. An assembly according to claim 17 wherein the pivot axes of said implement and said sifting member are spaced when said sifting member is mounted on said handle.

19. An assembly according to claim 17 wherein said sifting member is pivotally connectable to an underside of said handle.

20. An assembly according to claim 17 wherein said third displacing means comprises a fluid accuated cylinder assembly.

21. An assembly according to claim 17 wherein said sifting member functions to close an opening in said implement when said sifting member is mounted on said handle, and said implement is in a curled position engaging said sifting member.

22. An assembly according to claim 21 wherein said sifting member includes a perforated bottom panel, a front wall and a pair of spaced side walls.

23. Assembly according to claim 22 wherein said side walls of said sifting member are provided with transversely aligned recesses for receiving protruding cutting means formed on said implement when said sifting member is mounted on said handle and said implement engages said sifting member.

24. Assembly according to claim 18 when said control system is selectively operable to displace said implement between said curled and uncurled positions independently of the operation of said sifting member.

25. An assembly mountable on a machine having a boom, a handle pivotally connected to said boom, first means operatively interconnecting said boom and said handle for angularly displacing said handle relation to said boom, an implement connected to said handle for angularly displacing said handle relative to said boom, an implement connected to said handle for pivotal movement along an arcuate line of travel between curled and uncurled positions, and second means operatively interconnecting said handle and said implement for angularly displacing said implement relative to said handle, operable to perform, material working functions, comprising:

a sifter member connectable to said handle at a point adjacent to but spaced from the pivotal connection of said implement to said handle, for pivotal movement along an arcuate line of travel between retracted and extended positions, at least partially overlapping the arcuate line of travel of said implement whereby when said sifting member is in the retracted position, said implement is in the curled position adjacent said retracted sifting member and when said implement is displaced from its curled position to its uncurled position, said sifting member can be caused to be angularly displaced from its retracted position to its extended position following said implement in close proximity;

third means operatively interconnectable with said handle and said sifting member for pivoting said sifting member between said retracted and extended position when said sifting member is connected to said handle and said third displacing means operating interconnects said handle and sifting member; and control means operatively connectable to said second and third displacing means when said sifting member is connected to said handle and said third displacing means interconnects said handle and said sifting member, selectively operable in a first mode to cause said implement to curl and uncurl, and in a second mode to cause said implement to be disposed in its retracted position and, sequentially, said implement to be displaced between its uncurled position to its curled position, adjacent said sifting member in its retracted position, said implement to be displaced from its curled position to its uncurled position, said sifting member to be displaced from its retracted position to its extended position, following said implement in close proximity thereto, and said sifting member to be displaced from its extended position to its retracted position.

26. An assembly according to claim 25 wherein said third displacing means comprises a fluid actuated cylinder assembly.

27. An assembly according to claim 25 wherein said sifting member functions to close an opening in said implement when said sifting member and said implement are mounted on said handle, said sifting member is in its retracted position and said implement is in its curled position.

28. An assembly according to claim 27 wherein said sifting member includes a perforated bottom panel, a front wall and a pair of spaced side walls.

29. An assembly according to claim 28 wherein said side walls of said sifting member are provided with transversely aligned recesses for receiving protruding cutting means formed on said implement when said sifting member is mounted on said handle and disposed in its retracted position and said implement is disposed in its curled position.

30. An assembly according to claim 25 wherein said implement comprises a bucket.

* * * * *